US006034039A

United States Patent [19]

Gomes et al.

[11] Patent Number: 6,034,039

[45] Date of Patent: Mar. 7, 2000

[54] LUBRICATING OIL COMPOSITIONS

[75] Inventors: Jose Manuel Gaspar Gomes; Philip Skinner, both of Oxfordshire, United Kingdom

[73] Assignee: Exxon Chemical Patents, Inc., Linden, N.J.

[21] Appl. No.: 09/200,096

[22] Filed: Nov. 25, 1998

[30] Foreign Application Priority Data

| | | | |
|---|---|---|---|
| Nov. 28, 1997 | [GB] | United Kingdom | 9725353 |
| Dec. 2, 1997 | [GB] | United Kingdom | 9725534 |

[51] Int. Cl.[7] ..... C10M 159/22; C10M 159/24; C10M 163/00

[52] U.S. Cl. ..... 508/331; 508/332; 508/360; 508/398; 508/574; 508/583

[58] Field of Search ..... 508/398, 331, 508/332, 360, 574, 583

[56] References Cited

U.S. PATENT DOCUMENTS

| | | | |
|---|---|---|---|
| 2,719,125 | 9/1955 | Roberts . | |
| 2,719,126 | 9/1955 | Fields et al. . | |
| 3,087,932 | 4/1963 | Little, Jr. . | |
| 4,283,294 | 8/1981 | Clarke | 508/360 |
| 5,256,322 | 10/1993 | Cohu | 508/398 |
| 5,330,665 | 7/1994 | Cane et al. | 508/574 |
| 5,433,871 | 7/1995 | O'Connor et al. | 508/331 |
| 5,674,821 | 10/1997 | Cook et al. | 508/574 |
| 5,804,537 | 9/1998 | Boffa et al. | 508/398 |

FOREIGN PATENT DOCUMENTS

| | | |
|---|---|---|
| 024156 | 2/1981 | European Pat. Off. . |
| 312 312 A1 | 4/1989 | European Pat. Off. . |
| 317 348 A1 | 5/1989 | European Pat. Off. . |
| 347 103 A1 | 12/1989 | European Pat. Off. . |
| 208560 | 12/1997 | European Pat. Off. . |
| 97/46643 | 12/1997 | WIPO . |
| 97/46644 | 12/1997 | WIPO . |
| 97/46645 | 12/1997 | WIPO . |
| 97/46646 | 12/1997 | WIPO . |
| 97/46647 | 12/1997 | WIPO . |

OTHER PUBLICATIONS

Amos, R. and Albaugh, E.W. in "Chromatography in Petroleum Analysis", Altgelt, K.H. and Gouw, T.H., Eds, pp. 417 to 422, Marcel Dekker, Inc., New York and Basel, 1979.

Epton in Trans. Far. Soc. Apr. 1948, 226.

*Primary Examiner*—Jacqueline V. Howard

*Attorney, Agent, or Firm*—Ohlandt, Greeley, Ruggiero & Perle

[57] ABSTRACT

Complex detergents provide improved deposit control and corrosion protection in crankcase lubricants.

21 Claims, No Drawings

LUBRICATING OIL COMPOSITIONS

This invention relates to compositions suitable for use, inter alia, as lubricants, to compositions suitable, inter alia, as lubricant additives, and more especially to compositions comprising calcium overbased detergents, and to their use in lubricants.

In an internal combustion engine, acidic by-products from the combustion chamber mix with the lubricating oil and additives are provided in the oil to neutralize such acids and thereby reduce corrosion. Examples of such additives are overbased phenates, sulphonates, and salicylates of a number of metals, e.g., calcium and magnesium.

A typical crankcase lubricant will contain a number of such detergents, for example calcium sulphonate, calcium phenate, and magnesium sulphonate.

In earlier years, overbased materials contained only a single type of anion, but more recently compositions have been available that contain anions of two or more types, obtained either by mixing together two or more overbased materials having different types of anion or by the manufacture of a material in which two or more anions of different types are incorporated during overbasing, the last-mentioned materials being known as "hybrid" or "complex" detergents. Complex materials have the advantages that they contribute the properties given by two or more surfactants without the need to manufacture and blend separate materials, and that the problems of instability or incompatibility associated with separate materials are avoided.

In our co-pending International Applications Nos. EP97/02695, 02696, 02697, 02698, and 02699, (Published as WO 97/46645, 97/46643, 97/46644, 97/46646 and 97/146647) the disclosures of all of which are incorporated herein by reference, are described a number of such complex detergents, and processes for their manufacture, the detergents having a relatively high ratio of total base number (hereinafter TBN, measured in mg KOH/g according to ASTM D2896) to surfactant. These materials, because they combine high basicity with a relatively low surfactant content, provide an economic advantage.

The ratio of TBN to surfactant may be determined as described in any one of the above-mentioned international applications. These give details of how the percentage of total surfactant in a detergent is, and the proportions of individual surfactants are, measured. For convenience, these procedures are summarized in an Appendix below. The term "TBN:% surfactant ratio" as used in this specification, including the claims, is defined as the ratio of the TBN to the percentage of total surfactant in the detergent measured as described in the above-mentioned International applications and in the Appendix below.

As used herein, by the term "calcium detergent" is meant a detergent in which at least 80 mole %, typically at least 90 mole % and more especially at least 95 mole % of the cations are calcium.

It has surprisingly been found that by replacing some or all of one or more single anion detergents in a lubricant composition by a complex one, advantageously one described in one of the above-mentioned International applications, the same protection against corrosion may be obtained at a lower TBN or a greater protection may be obtained at the same TBN.

The multifunctional complex detergent facilitates enhanced performance in corrosion protection and deposit control at least when both sulphonate and phenate are present.

The present invention accordingly provides in a first aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of which is a sulphurized or non-sulphurized phenol or a derivative thereof and the other, or at least one other, of which is a surfactant other than a phenol surfactant, the proportion, measured as described herein, of the said phenol in the surfactant system being at least 45 mass %, and the overbased detergent having a TBN:% surfactant ratio (as hereinbefore defined) of at least 14, advantageously at least 15, especially at least 19.

The present invention also provides in a second aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least surfactants, at least one of which is sulphurized or nonsulphurized salicylic acid or a derivative thereof and the other, or at least one other, of which is a surfactant other than a salicylic surfactant, the proportion, measured as described herein, of the said salicylic acid in the surfactant system being at least 25 mass %, and the overbased detergent having a TBN:% surfactant ratio (as hereinbefore defined) of at least 16.

The present invention further provides in a third aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least three surfactants, at least one of the surfactants being a sulphurized or non-sulphurized phenol or a derivative thereof, at least one other of the surfactants being a sulphurized or non-sulphurized salicylic acid or a derivative thereof, the third, or a third, surfactant being a surfactant other than a phenol or salicylic surfactant, the proportion, measured as described herein, of the said phenol in the surfactant system being at least 35 mass %, and the overbased detergent having a TBN:% surfactant ratio (as hereinbefore defined) of at least 11, preferably at least 12.

The present invention further provides in a fourth aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants other than (c) an acid of the formula $R^a$—CH($R^b$)—COOH, wherein $R^a$ represents an alkyl or alkenyl group containing 10 to 24 carbon atoms and $R^b$ represents hydrogen, an alkyl group with 1 to 4 carbon atoms, or a $CH_2COOH$ group, or an acid anhydride, acid chloride or ester thereof, and (d) a di- or polycarboxylic acid containing from 36 to 100 carbon atoms or an acid anhydride, acid chloride or ester thereof, at least one of the surfactants being a sulphurized or non-sulphurized phenol or a derivative thereof and the other, or at least one other, of the surfactants being a surfactant other than a phenol surfactant, the proportion, measured as described herein, of the said phenol in the surfactant system being at least 35 mass %, and the overbased detergent having a TBN:% surfactant ratio (as hereinbefore defined) of at least 15.

The present invention further provides in a fifth aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants other than (c) an acid of the formula $R^a$—CH($R^b$)—COOH, wherein $R^a$ represents an alkyl or alkenyl group containing 10 to 24 carbon atoms and $R^b$ represents hydrogen, an alkyl group with 1 to 4 carbon atoms, or a $CH_2COOH$ group, or an acid anhydride, acid chloride or ester thereof, and (d) a di- or polycarboxylic acid containing from 36 to 100 carbon atoms or an acid anhydride, acid chloride or ester thereof, at least one of the surfactants being a sulphurized or non-sulphurized salicylic acid or a derivative thereof and the other, or at least one other, of the surfactants being a surfactant other than a salicylic surfactant, the proportion, measured as described herein, of the said salicylic acid in the surfactant system being at least 10 mass %, and the overbased detergent having a TBN:% surfactant ratio (as hereinbefore defined) of at least 11.

The present invention further provides in a sixth aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of the surfactants being a sulphurized or non-sulphurized phenol or a derivative thereof and the other, or at least one other, of the surfactants being a sulphurized or non-sulphurized salicylic acid or a derivative thereof, the total proportion, measured as described herein, of the said phenol and the said salicylic acid in the surfactant system being at least 55 mass %, and the overbased detergent having a TBN:% surfactant ratio (as hereinbefore defined) of at least 11, preferably at least 13.

Advantageously, in the sixth aspect, when the ratio is less than 13, the total proportion of the phenol and the salicylic acid is at least 65 mass %.

The present invention further provides in a seventh aspect a lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of which is a sulphurized or non-sulphurized phenol or a derivative thereof and the other, or at least one other, of which is a surfactant other than a phenol surfactant, the proportion, measured as described herein, of the said phenol in the surfactant system being at least 15 mass %, and the overbased detergent having a TBN:% surfactant ratio (as hereinbefore defined) of at least 21.

In addition to the advantage mentioned above, a composition of the invention gives, in certain circumstances, another important advantage, that of reduced wear. In order to pass the Sequence IID corrosion test, described below, at an acceptable cost, it has frequently been necessary to include an overbased magnesium sulphonate in the composition. It has been found, however, that magnesium overbased detergents cause more wear than calcium overbased detergents and therefore require a higher level of anti-wear agent in the composition. The replacement of some or all magnesium sulphonate by detergent (b) allows a lower proportion of anti-wear agent to be used, thereby further reducing cost.

Advantageously, therefore, the composition of the invention is substantially magnesium-free.

The invention also provides an additive concentrate comprising detergents (a) and (b) as defined above in an oil, or a solvent or dispersant miscible with oil, the total proportion of detergent in the concentrate being from 2.5 to 90, advantageously from 5 to 75, and preferably from 8 to 60, mass %.

As examples of the detergent (a) there may be mentioned neutral and overbased phenates, salicylates, and sulphonates, advantageously of Group 1 and Group 2 metals of the Periodic Table, especially calcium and magnesium. The anions of detergent (a) materials are from a single group, e.g., are phenol-derived, or sulphonic acid-derived, but it is within the scope of the invention to employ a mixture of anions within a single group. For example, when a sulphurized phenol surfactant is used and has been prepared by the reaction of elemental sulphur and a phenol, the number of sulphur atoms bridging the phenolic moieties will vary, as may the number of phenolic moieties linked by sulphur. The reader is referred to the above-mentioned International Applications for examples of anions suitable for use in detergent (a), including those of sulphurized and non-sulphurized phenols, aldehyde-modified phenols, Mannich-base condensed phenols, sulphurized and non-sulphurized salicylic acids, sulphonic acids, carboxylic acids and naphthenic acids.

As examples of preferred detergent (a), there may be mentioned calcium sulphonates having a TBN of at least 50, especially from 350 to 450, more especially about 400, calcium phenates having a TBN of up to 160, calcium salicylates having a TBN up to 100, and calcium sulphonates having a TBN of up to 50.

As examples of detergent (b), there may be mentioned all those hybrid or complex detergents described in the above-mentioned International Applications. Advantageously, in the first aspect, the proportion of the phenol in the surfactant system of detergent (b) is at least 55 mole %. Advantageously, the phenol if present is hydrocarbyl, preferably alkyl, substituted. Advantageously, one of the surfactants from which detergent (b) is derived is a sulphonic acid (or derivative), advantageously a hydrocarbyl, preferably alkyl, substituted aryl sulphonic acid. As a preferred example, there may be mentioned a calcium phenatelsulphonate of mass ratio about 50:50, having a standardized TBN of 385 and a TBN:% surfactant ratio of 20.

The detergent (b) is advantageously made by the process described in WO 97/46646.

It is within the scope of the invention to use two or more simple detergents, detergents (a); it is also within the scope of the invention to use two or more complex detergents, detergents (b). In a preferred embodiment, the composition comprises at least one simple overbased calcium phenate, at least one simple calcium overbased sulphonate, and at least one complex calcium overbased sulphonate; advantageously at least one simple detergent is, and preferably at least two are, of low TBN (at most 160 in the case of phenate and at most 50 in the case of sulphonate).

Advantageously the simple detergent(s):complex detergent mass ratio is from 1:5 to 5:1, preferably from 1:3 to 3:1, and more preferably from 2:3 to 3:2.

Advantageously, the total proportion of the two detergents (a) and (b) in a lubricating oil composition according to the invention is within the range of from 0.25 to 3, preferably 0.5 to 1.5, and more preferably 0.75 to 1.25, mass per cent, of active ingredient.

The detergents may be incorporated into a base oil in any convenient way. They may be added directly to the oil by dispersing or by dissolving them in the oil at the desired level of concentration, optionally with the aid of a suitable solvent such, for example, as toluene or cyclohexane. Such blending can occur at room temperature or at elevated temperature.

Detergent compositions according to, or prepared in accordance with, the invention are particularly useful in lubricating oil compositions which employ a base oil in which the mixtures are dissolved or dispersed. Base oils with which the detergent compositions may be used are especially those suitable for use as crankcase lubricating oils for spark-ignited and compression-ignited internal combustion engines, for example, automobile and truck engines.

Synthetic base oils include alkyl esters of dicarboxylic acids, polyglycols and alcohols; poly-α-olefins, including polybutenes; alkyl benzenes; organic esters of phosphoric acids; and polysilicone oils.

Natural base oils include mineral lubricating oils which may vary widely as to their crude source, for example, as to whether they are paraffinic, naphthenic, mixed, or paraffinic-naphthenic, as well as to the method used in their production, for example, their distillation range and whether they are straight run or cracked, hydrofined, or solvent extracted.

Lubricating oil base stocks suitable for use in crankcase lubricants conveniently have a viscosity of 2.5 to 12 cSt, ($mm^2/s$), at 100° C., although base stocks with other viscosities may be used, for example, bright stock.

The lubricating oil composition in accordance with the present invention comprises lubricating oil, typically in a major proportion, and the detergents (a) and (b), typically in a minor proportion.

Advantageously, detergent (a) is present in a proportion within the range of from 0.005 to 2.5, preferably from 0.05 to 1.5, and most preferably from 0.25 to 1, mass %, based on the total mass of lubricant composition. Advantageously, detergent (b) is present in a proportion within the range of from 0.005 to 1.5, preferably from 0.05 to 1.25, and most preferably from 0.25 to 0.75, mass %, based on the total mass of lubricant composition.

Additional additives may be incorporated in the composition to enable it to meet particular requirements. Examples of additional additives which may be included in lubricating oil compositions containing a detergent composition in accordance with the invention are viscosity index improvers, corrosion inhibitors, oxidation inhibitors or antioxidants, friction modifiers, dispersants, other detergents, metal rust inhibitors, anti-wear agents, pour point depressants, and antifoaming agents.

Viscosity index improvers (or viscosity modifiers) impart high and low temperature operability to a lubricating oil and permit it to remain shear stable at elevated temperatures and also exhibit acceptable viscosity or fluidity at low temperatures.

Suitable compounds for use as viscosity modifiers are generally high molecular weight hydrocarbon polymers, including polyesters, and viscosity index improver dispersants, which function as dispersants as well as viscosity index improvers. Oil-soluble viscosity modifying polymers generally have weight average molecular weights of from about 10,000 to 1,000,000, preferably 20,000 to 500,000, as determined by gel permeation chromatography or light scattering methods.

Corrosion inhibitors reduce the degradation of metallic parts contacted by the lubricating oil composition. Thiadiazoles, for example those disclosed in U.S. Pat. No. 2,719,125, 2,719,126 and 3,087,932, are examples of corrosion inhibitors for lubricating oils.

Oxidation inhibitors, or antioxidants, reduce the tendency of mineral oils to deteriorate in service, evidence of such deterioration being, for example, the production of varnish-like deposits on metal surfaces and of sludge, and viscosity increase. Suitable oxidation inhibitors include sulphurized alkyl phenols and alkali or alkaline earth metal salts thereof; diphenylamines; phenyl-naphthylamines; and phosphosulphurized or sulphurized hydrocarbons.

Other oxidation inhibitors or antioxidants which may be used in lubricating oil compositions comprise oil-soluble copper compounds. The copper may be blended into the oil as any suitable oil-soluble copper compound. By oil-soluble it is meant that the compound is oil-soluble under normal blending conditions in the oil or additive package. The copper may, for example, be in the form of a copper dihydrocarbyl thio- or dithio-phosphate. Alternatively, the copper may be added as the copper salt of a synthetic or natural carboxylic acid, for example, a $C_8$ to $C_{18}$ fatty acid, an unsaturated acid, or a branched carboxylic acid. Also useful are oil-soluble copper dithiocarbamates, sulphonates, phenates, and acetylacetonates. Examples of particularly useful copper compounds are basic, neutral or acidic copper $Cu^I$ and/or $Cu^{II}$ salts derived from alkenyl succinic acids or anhydrides.

Friction modifiers and fuel economy agents which are compatible with the other ingredients of the final oil may also be included. Examples of such materials are glyceryl monoesters of higher fatty acids, esters of long chain polycarboxylic acids with diols, and oxazoline compounds, and oil-soluble molybdenum compounds.

Dispersants maintain oil-insoluble substances, resulting from oxidation during use, in suspension in the fluid, thus preventing sludge flocculation and precipitation or deposition on metal parts. So-called ashless dispersants are organic materials which form substantially no ash on combustion, in contrast to metal-containing (and thus ash-forming) detergents. Borated metal-free dispersants are also regarded herein as ashless dispersants. Suitable dispersants include, for example, derivatives of long chain hydrocarbon-substituted carboxylic acids in which the hydrocarbon groups contain 50 to 400 carbon atoms, examples of such derivatives being derivatives of high molecular weight hydrocarbyl-substituted succinic acid. Such hydrocarbyl-substituted carboxylic acids may be reacted with, for example, a nitrogen-containing compound, advantageously a polyalkylene polyamine, or with an ester. Particularly preferred dispersants are the reaction products of polyalkylene amines with alkenyl succinic anhydrides.

A viscosity index improver dispersant functions both as a viscosity index improver and as a dispersant. Examples of viscosity index improver dispersants suitable for use in lubricating compositions include reaction products of amines, for example polyamines, with a hydrocarbyl-substituted mono- or dicarboxylic acid in which the hydrocarbyl substituent comprises a chain of sufficient length to impart viscosity index improving properties to the compounds.

Examples of dispersants and viscosity index improver dispersants may be found in EP-A-24146.

Additional detergents and metal rust inhibitors include the metal salts, which may be overbased, of sulphonic acids, alkyl phenols, sulphurized alkyl phenols, alkyl salicylic acids, thiophosphonic acids, naphthenic acids, and other oil-soluble mono- and dicarboxylic acids. Representative examples of detergents/rust inhibitors, and their methods of preparation, are given in EP-A-208 560.

Antiwear agents, as their name implies, reduce wear of metal parts. Zinc dihydrocarbyl dithiophosphates (ZDDPs) are very widely used as antiwear agents. Especially preferred ZDDPs for use in oil-based compositions are those of the formula $Zn[SP(S)(OR^1)(OR)]_2$ wherein $R^1$ and $R^2$ represent alkyl groups, each containing from 1 to 18, and preferably 2 to 12, carbon atoms.

Pour point depressants, otherwise known as lube oil flow improvers, lower the minimum temperature at which the fluid will flow or can be poured. Such additives are well known. Foam control may be provided by an antifoamant of the polysiloxane type, for example, silicone oil or polydimethyl siloxane.

Some of the above-mentioned additives may provide a multiplicity of effects; thus for example, a single additive may act as a dispersant-oxidation inhibitor. This approach is well known and need not be further elaborated herein.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | Mass % a.i. (Broad) | Mass % a.i. (Preferred) |
|---|---|---|
| Viscosity Modifier | 0.01–6 | 0.01–4 |
| Corrosion Inhibitor | 0.01–5 | 0.01–1.5 |
| oxidation Inhibitor | 0.01–5 | 0.01–1.5 |
| Friction Modifier | 0.01–5 | 0.01–1.5 |
| Dispersant | 0.1–20 | 0.1–8 |
| Detergents/rust inhibitors | 0.01–6 | 0.01–3 |
| Anti-wear Agent | 0.01–6 | 0.01–4 |
| Pour Point Depressant | 0.01–5 | 0.01–1.5 |
| Anti-Foaming Agent | 0.001–3 | 0.001–0.15 |
| Mineral or Synthetic Base Oil | Balance | Balance |

* Mass % active ingredient based on the final oil.

It will be understood that the various components of the composition, the essential components as well as the optional and customary components, may react under the conditions of formulation, storage, or use, and that the invention also provides the product obtainable or obtained as a result of any such reaction.

The following examples, in which all parts and percentages are by weight unless indicated otherwise, illustrate the invention.

The Sequence IID and VW Intercooled Turbodiesel tests are carried out in accordance with ASTM STP 315 H and CEC L-46 T-63 procedures, respectively.

Example A (Comparative)

In this example various samples of a commercially available heavy duty lubricating oil were subjected to the above-mentioned Sequence IID test. The composition of the oils, with an average TBN of 9.01, was as follows:

| | Mass per cent |
|---|---|
| Magnesium sulphonate, TBN 400 | 0.25 |
| Calcium sulphonate, TBN 300 | 0.55 |
| Calcium sulphonate, TBN 27 | 0.45 |

-continued

| | |
|---|---|
| Calcium phenate, TBN 135 | 0.45 |
| Additives for other functions | 8.00 |
| Base Oil (Solvent Neutral 175) | balance. |
| Average test results were as follows: | |
| | Merits |
| Lifter Bodies | 8.63 |
| Plungers | 8.67 |
| Balls | 8.60 |
| Relief Valve Plunger | 8.00 |
| Pushrods | 8.78 |
| Severity Adjustment | 0.00 |
| Average Rust | 8.56 |
| Pass/Fail | pass |

Examples 1 to 4

In these examples, a complex calcium phenate/sulphonate, 50:50 mass phenate: sulphonate ratio, TBN 385, TBN:% surfactant ratio 20:1, referred to below as the complex detergent, wholly or partly replaced various of the detergents of the reference composition. The composition and the results of the Sequence IID results are given below:

| Example No. | 1 | 2 | 3 | 4 |
|---|---|---|---|---|
| Magnesium sulphonate, TBN 400 | — | — | — | — |
| Calcium sulphonate, TBN 300 | — | — | — | — |
| Calcium sulphonate, TBN 27 | 0.45 | 0.45 | 0.45 | 0.45 |
| Calcium phenate, TBN 135 | — | — | 0.23 | 0.23 |
| Complex detergent | 1.12 | 0.70 | 0.55 | 0.40 |
| Oil, Additives for other purposes | Balance | | | |
| TBN of oil | 11.64 | 8.23 | 7.61 | 6.38 |
| Test Results, Merits | | | | |
| Lifter Bodies | 8.84 | 8.84 | 8.72 | 8.34 |
| Plungers | 8.76 | 8.77 | 8.81 | 8.81 |
| Balls | 8.60 | 8.45 | 8.56 | 8.68 |
| Relief Valve Plunger | 8.24 | 8.06 | 8.05 | 8.40 |
| Pushrods | 8.86 | 8.83 | 8.84 | 8.80 |
| Severity Adjustment | 0 | 0 | 0 | −0.08 |
| Average Rust | 8.66 | 8.59 | 8.62 | 8.54 |
| Pass/Fail | Pass | Pass | Pass | Pass |

The results show that magnesium-based detergent may be replaced by a complex calcium detergent while still passing the IID Sequencing test, with the potential for reducing the cost of anti-wear agents. The results also show that the combination of a lower proportion of a simple calcium phenate with a complex detergent gives comparable corrosion protection at a lower total TBN.

Examples B (Comparative) and 5 to 8

In these Examples, lubricating oil compositions according to the invention were compared with a commercially available heavy duty lubricating oil in the VW Intercooled Diesel test, a measure of deposit control. The complex calcium detergent (b) was incorporated in the oil at a constant level, and the simple detergents in the commercial oil replaced on different bases; in Example 5 on an equi-sulphonate and equi-phenate basis; in Example 6 at an approximately equal TBN, and in Example 7 at equi-phenate only. In Example 8, also run on an equiphenate basis, a different nonyl phenyl sulphide (NPS) was used, one derived from a lower chlorine content source. It is believed that the failure of Example 7 in the test, caused by a pinched piston ring, was an isolated failure, and not due to the absence of the high TBN magnesium sulphonate. The compositions and results are shown below.

| | B | 5 | 6 | 7 | 8 |
|---|---|---|---|---|---|
| Magnesium sulphonate, TBN 400 | 0.25 | — | — | — | — |
| Calcium sulphonate, TBN 300 | 0.8 | 0.8 | — | — | — |
| Calcium sulphonate, TBN 27 | 0.45 | 0.45 | 0.45 | 0.45 | 0.45 |
| Calcium phenate, TBN 135 | 0.5 | 0.28 | 0.5 | 0.28 | 0.28 |
| Complex detergent | — | 0.55 | 0.55 | 0.55 | 0.55 |
| TBN | 9.1 | 12.5 | 8.3 | 7.7 | 7.7 |
| % Phenate | 0.47 | 0.47 | 0.68 | 0.47 | 0.47 |
| % Sulphonate | 1.1 | 1.1 | 0.8 | 0.8 | 0.8 |
| Oil, additives for other purposes | | | Balance | | |
| Merits | 7.4 | 7.4 | 72 | 7.4 | 7.3 |
| Pinched Rings | 0 | 0 | 0 | 1 | 0 |
| Pass/Fail | Pass | Pass | Pass | Fail | Pass |

The compositions according to the invention provide the necessary deposit control, while avoiding the need for a magnesium-based detergent, thus allowing a lower antiwear agent level. Further, the lower TBN of Examples 6 to 8 represents a desirably lower ash content.

The use of the complex detergent also makes it possible to use a lower treat rate of low base number calcium phenate.

The complex detergent used in Examples 1 to 8 above was made according to the procedure described below.

Toluene (540 g), methanol (276 g) and diluent oil (150N) (22 g) were introduced into a reactor and mixed while maintaining the temperature at approximately 20° C. Calcium hydroxide ($Ca(OH)_2$) (145 g) was added, and the mixture was heated to 40° C., with stirring. To the slurry obtained in this way was added a mixture, maintained at 40° C. of the phenol (230 g) and of the sulphonic acid (110 g) surfactants identified below and toluene (100 g), followed by a further quantity (50 g) of toluene, and water (22 g).

After neutralization of the surfactants by the calcium hydroxide, the temperature of the mixture was reduced to approximately 28° C. and was maintained at approximately 28° C. while carbon dioxide (62 g) was injected into the mixture at a rate such that substantially all the carbon dioxide was absorbed in the reaction mixture to form the basic material. The temperature was then raised to 60° C. over 60 minutes, following which the mixture was cooled to a temperature of approximately 28° C. over 30 minutes. At 28° C., a further quantity of calcium hydroxide (124 g) was added and carbon dioxide (62 g) was charged. After this second carbonation step, the temperature was raised to 60° C. over 90 minutes.

Subsequently, the volatile materials were distilled off, a second charge of diluent oil (243 g) was introduced, and the product was filtered to remove sediment. The product had a TBN of 385, and a TBN:% surfactant ratio of about 20.

The phenol surfactant was a sulphurized alkyl phenol, obtained from sulphur monochloride and a blend of tertiary nonyl phenols (predominantly para) and di(tertiary nonyl) phenols (predominantly ortho and para). The sulphonic acid surfactant was an alkylbenzene sulphonic acid, molecular weight 683. Although the surfactants were applied at an approximately 2:1 mass ratio, a lower proportion of the phenol than of the sulphonate reacts with calcium, and the final calcium detergent has an approximately 50:50 mass ratio of phenate: sulphonate.

Appendix

The percentage of surfactant in the complex detergent, and the percentages of the individual surfactants, for example, the phenol, in the surfactant system, are the percentages measured by the methods set out below.

1. Dialysis of the overbased detergent

A known amount (A g, approximately 20 g) of the liquid complex overbased detergent (substantially free from other lubricating oil additives) is dialysed through a membrane in a Soxhlet extractor (150 mm height×75 mm internal diameter) using n-hexane siphoning at a rate of 3 to 4 times per hour for 20 hours. The membrane should be one which retains substantially all the metal containing material and passes substantially all the remainder of the sample. An example of a suitable membrane is a gum rubber membrane supplied by Carters Products, Division of Carter Wallace Inc., New York, N.Y. 10105 under the trade name Trojans. The dialysate and residue obtained on completion of the dialysis step are evaporated to dryness, any remaining volatile material then being removed in a vacuum oven (100° C. at less than 1 torr or less than about 130 Pa). The mass of the dried residue, in grams, is designated B. The percentage (C) of overbased detergent material in the liquid sample is given by the equation:

$$C = \frac{B}{A} \times 100\%$$

Background information for the dialysis technique is given by Amos, R. and Albaugh, E. W. in "Chromatography in Petroleum Analysis", Altgelt, K. H. and Gouw, T. H., Eds, pages 417 to 422, Marcel Dekker, Inc., New York and Basel, 1979.

2. Determination of TBN:% total surfactant ratio

A known amount (D g, approximately 10 g) of the dried residue is hydrolysed as specified in sections 8.1 to 8.1.2 of ASTM D3712, except that at least 200 ml of 25% by volume hydrochloric acid (sp. gr. 1.18) is used in section 8.1.1. The amount of hydrochloric acid used should be sufficient to effect acidification/hydrolysis of the overbased detergent residue into organic materials (surfactants) and inorganic materials (calcium-containing materials, for example, calcium chloride). The combined ether extracts are dried by passing them through anhydrous sodium sulphate. The sodium sulphate is rinsed with clean ether, and the combined ether solutions are evaporated to dryness (at approximately 110° C.) to yield a hydrolysed residue. The mass of the dried hydrolysed residue, in grams, is designated E.

The percentage, Y, of total surfactants in the original liquid overbased detergent is given by the equation:

$$Y = \frac{E}{D} \times C$$

and the TBN:% total surfactant ratio, X, is given by the equation:

$$X = \frac{TBN \text{ of the liquid overbased detergent}}{Y}$$

It will be noted that, in determining X, the mass of the surfactants in their free form (that is, not in the form of a salt or other derivative) is used.

3. Determination of individual surfactants (in their free form) in the surfactant system The techniques described below isolate the individual surfactants, in hydrolysed form, from the hydrolysed surfactant mixture derived from the overbased detergent. As indicated below, the proportion of each individual surfactant is the proportion by mass of the individual surfactant, in hydrolysed form, in the hydrolysed surfactant mixture. Thus, where, for example, the overbased detergent contains a calcium phenate/sulphonate/salicylate surfactant system, the proportions of the individual surfactants in the surfactant system are expressed as the proportions of phenol, sulphonic acid and salicylic acid respectively.

The proportions of individual surfactants may be determined by the following method.

A known amount (F g, approximately 1 g) of the dried hydrolysed residue obtained as described above is placed at the top of a 450×25 mm (internal diameter) fritted glass column filled with 60–100 US mesh (150 to 250 $\mu$m) Florisil. Florisil is magnesium silicate with a CAS number of 8014-97-9. The column is eluted with a 250 ml portion of each of seven solvents of increasing polarity, namely, heptane, cyclohexane, toluene, ethyl ether, acetone, methanol, and, lastly, a mixture of 50 volume % chloroform, 44 volume % isopropanol, and 6 volume % ammonia solution (sp. gr. 0.88). Each fraction is collected, evaporated to dryness, and the resulting residue is weighed and then analysed to determine the amount ($G^1$, $G^2$, $G^3$. . . g) and nature of the surfactant(s) contained in the fraction.

Analysis of the fractions (or of the hydrolysed residue) can be carried out by, for example, chromatographic, spectroscopic, and/or titration (colour indicator or potentiometric) techniques known to those skilled in the art. Where the overbased detergent contains a sulphonate surfactant and a salicylate surfactant, the sulphonic acid and salicylic acid obtained by hydrolysis of these surfactants will usually be eluted from the column together. In this case, and in any other case where it is necessary to determine the proportion of sulphonic acid in a mixture containing it, the proportion of sulphonic acid in the mixture may be determined as described by Epton in Trans.Far.Soc. April 1948, 226.

In the above method, the mass (in grams, designated H') of a given surfactant, in hydrolysed form, is determined from the fractions) containing it, and thus the proportion of that surfactant in the surfactant system of the original overbased detergent is $$\frac{H^1}{F} \times 100\%$$

The percentages (by mass) of the individual surfactants (in their free form, that is, not in the form of a salt or other derivative) based on the surfactant system may be predicted from the proportions of the surfactants used as starting materials, provided that the percentage of "reactive ingredient" (i.e., the percentage of starting material that reacts with calcium and does not remain in unreacted, non-salt, form in the liquid detergent) is known for each of the surfactant starting materials. The percentage of the total surfactants (in their free form) in the liquid overbased product may then be predicted, and the TBN:% surfactant ratio determined.

What is claimed is:

1. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of which is a sulphurized or non-sulphurized phenol and the other, or at least one other, of which is a surfactant other than a phenol surfactant, the proportion of the said phenol in the surfactant system being at least 45 mass %, and the overbased detergent having a TBN: surfactant ratio of at least 14.

2. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of which is sulphurized or non-sulphurized, salicylic acid and the other, or at least one other, of which is a surfactant other than a salicylic surfactant, the proportion of the said salicylic acid in the surfactant system being at least 25 mass %, and the overbased detergent having a TBN:% surfactant ratio of at least 16.

3. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least three surfactants, at least one of the surfactants being a sulphurized or non-sulphurized phenol, for a derivative thereon, at least one other of the surfactants being a sulphurized or non-sulphurized salicylic acid or a derivative thereof, the third, or a third, surfactant being a surfactant other than a phenol or salicylic surfactant, the proportion of the said phenol in the surfactant system being at least 35 mass %, and the overbased detergent having a TBN:% surfactant ratio of at least 11.

4. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants other than (c) an acid of the formula $R^a$—CH($R^b$)—COOH, wherein $R^a$ represents an alkyl or alkenyl group containing 10 to 24 carbon atoms and $R^b$ represents hydrogen, an alkyl group with 1 to 4 carbon atoms, or a $CH_2COOH$ group, or an acid anhydride, acid chloride. or ester thereof, and (d) a di- or polycarboxylic acid containing from 36 to 100 carbon atoms or an acid anhydride, acid chloride or ester thereof, at least one of the surfactants being a sulphurized or non-sulphurized phenol and the other, or at least one other, of the surfactants being a surfactant other than a phenol surfactant, the proportion of the said phenol in the surfactant system being at least 35 mass %, and the overbased detergent having a TBN:% surfactant ratio of at least 15.

5. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants other than (c) an acid of the formula $R^a$—CH($R^b$)—COOH, wherein $R^a$ represents an ally or alkenyl group containing 10 to 24 carbon atoms and $R^b$ represents hydrogen, an alkyl group with 1 to 4 carbon atoms, or a $CH_2COOH$ group, or an acid anhydride, acid chloride or ester thereof, and (d) a di- or polycarboxylic acid containing from 36 to 100 carbon atoms or an acid anhydride, acid chloride or ester thereof, at least one of the surfactants being a sulphurized or non-sulphurized salicylic acid and the other, or at least one other, of the surfactants being a surfactant other than a salicylic surfactant, the proportion of the said salicylic acid in the surfactant system being at least 10 mass %, and the overbased detergent having a TBN:% surfactant ratio of at least 11.

6. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of the surfactants being a sulphurized or non-sulphurized phenol and the other, or at least one other, of the surfactants being a sulphurized or non-sulphurized salicylic acid, the total proportion of the said phenol and the said salicylic acid in the surfactant system being at least 55 mass %, and the overbased detergent having a TBN:% surfactant ratio of at least 11.

7. A lubricating oil composition comprising a mixture of at least two metal-containing detergents, a first, detergent (a), being a metal phenate, sulphonate, salicylate, naphthenate, or carboxylate, and a second, detergent (b), being a calcium overbased detergent comprising a surfactant system derived from at least two surfactants, at least one of which is a sulphurized or non-sulphurized phenol and the other, or at least one other, of which is a surfactant other than a phenol surfactant, the proportion of the said phenol in the surfactant system being at least 15 mass %, and the overbased detergent having a TBN:% surfactant ratio of at least 21.

8. A composition as claimed in claim 1, wherein at least one of the surfactants from which component (b) is derived is an alkyl, substituted phenol.

9. A composition as claimed in claim 1, wherein at least one of the surfactants from which detergent (b) is derived is a sulphonic acid or derivative thereof.

10. A composition as claimed in claim 9, wherein the sulphonic acid is an alkyl, substituted aryl sulphonic acid.

11. A composition as claimed in claim 1, wherein detergent (a) is a calcium containing overbased detergent.

12. A composition as claimed in claim 11, wherein detergent (a) is a phenate or sulphonate.

13. A composition as claimed in claim 12, wherein detergent (a) is a calcium sulphonate of TBN of at least 50.

14. A composition as claimed in claim 12, wherein detergent (a) comprises a calcium phenate of TBN at most 160.

15. A composition as claimed in claim 12, wherein detergent (a) comprises a calcium sulphonate of TBN at most 50.

16. A composition as claimed in claim 1, wherein detergent (a) and detergent (b) are present in a mass ratio of from 1:5 to 5:1, advantageously from 1:3 to 3:1, preferably from 2:3 to 3:2.

17. A composition as claimed in claim 1, wherein detergents (a) and (b) are present in a total proportion of from 0.25 to 3, mass per cent, based on the total mass of the lubricating oil composition.

18. An additive concentrate comprising detergents (a) and (b) as defined in any one of claims 1 to 7 in an oil, or a solvent or dispersant miscible with oil, the total proportion of detergent in the concentrate being from 2.5 to 90 mass %.

19. A composition as claimed in any one of claims 1 to 7 that is substantially magnesium-free.

20. A method to provide corrosion protection or deposit control at a lower TBN or greater protection or control at the same TBN of a crankcase lubricating oil containing a detergent which is a metal phenate, sulphonate, salicylate, naphthenate or carboxylate, the method comprising providing in the crankcase lubricating oil a second detergent which is selected from:

(1) a calcium overbased detergent comprising a surfactant system derived from at least two surfactants, at least one of which is a sulphurized or non-sulphurized phenol; and the other, or at least one other, of which is a surfactant other than a phenol surfactant, the proportion of the said phenol in the surfactant system being at least 45 mass %, and the overbased detergent having a TBN:% surfactant ratio of at least 14;

(2) a calcium overbased detergent comprising a surfactant system derived from at least two surfactants, at least one of which is sulphurized or non-sulphurized salicylic acid and the other, or at least one other, of which is a surfactant other than a salicylic surfactant, the proportion of the said salicylic acid in the surfactant system being at least 25 mass %, and the overbased detergent having a TBN:% surfactant ratio of at least 16;

(3) a calcium overbased detergent comprising a surfactant system derived from at least three surfactants, at least one of the surfactants being a sulphurized or non-sulphurized phenol, at least one other of the surfactants being a sulphurized or non-sulphurized salicylic acid, the third, or a third, surfactant being a surfactant other, than a phenol or salicylic surfactant, the proportion of the said phenol in the surfactant system being at least 35 mass %, and the overbased detergent having a TBN:% surfactant ratio of at least 11;

(4) a calcium overbased detergent comprising a surfactant system derived from at least two surfactants other than (c) an acid of the formula $R^a$—CH($R^b$)—COCOH, wherein $R^a$ represents an alkyl or alkenyl group containing 10 to 24 carbon atoms and $R^b$ represents hydrogen, an alkyl group with 1 to 4 carbon atoms, or a $CH_2COOH$ group, or an acid anhydride, acid chloride or ester thereof, and (d) a di- or polycarboxylic acid containing from 36 to 100 carbon atoms or an acid anhydride, acid chloride or ester thereof, at least one of the surfactants being a sulphurized or non-sulphurized phenol and the other, or at least one other, of the surfactants being a surfactant other than a phenol surfactant, the proportion of the said phenol is the surfactant system being at least 35 mass %, and the overbased detergent having a TBN:% surfactant ratio of at least 15;

(5) a calcium overbased detergent comprising a surfactant system derived from at least two surfactants other than (c) an acid of the formula $R^a$—CH($R^b$)—COOH, wherein $R^a$ represents an alkyl or alkenyl group containing 10 to 24 carbon atoms and $R^b$ represents hydrogen, an alkyl group with 1 to 4 carbon atoms, or a $CH_2COOH$ group, or an acid anhydride, acid chloride or ester thereof, and (d) a di- or polycarboxylic acid containing from 36 to 100 carbon atoms or an acid anhydride, acid chloride or ester thereof, at least one of the surfactants being a sulphurized or non-sulphurized salicylic acid and the other, or at least one other, of the surfactants being a surfactant other than a salicylic surfactant, the proportion of the said salicylic acid in the surfactant system being at least 10 mass %, and thee overbased detergent having a TBN:% surfactant ratio of at least 11;

(6) a calcium overbased detergent comprising a surfactant system derived from at least two surfactants, at least one of the surfactants being a sulphurized or non-sulphurized phenol and the other, or at least one other, of the surfactants being a sulphurized or non-sulphurized salicylic acid, the total proportion of the said phenol and the said salicylic acid in the surfactant system being at least 55 mass %, and the overbased detergent having a TBN:% surfactant ratio of at least 11; and (7) a calcium overbased detergent comprising a surfactant system derived from at least two surfactants, at least one of which is a sulphurized or non-sulphurized phenol and the other, or at least one other, of which is a surfactant other than a phenol surfactant, the proportion of the said phenol in the surfactant system being at least 15 mass %, and the overbased detergent having a TBN:% surfactant ratio of at least 21.

21. An additive concentrate as claimed in claim 18 that is substantially magnesium-free.

* * * * *